United States Patent [19]

Dawdy

[11] 4,069,640

[45] Jan. 24, 1978

[54] METHOD OF MOUNTING AND DEMOUNTING A WALLBOARD WALL

[75] Inventor: Jack A. Dawdy, Kenmore, N.Y.

[73] Assignee: National Gypsum Company, Buffalo, N.Y.

[21] Appl. No.: 734,180

[22] Filed: Oct. 20, 1976

[51] Int. Cl.[2] ..... E04B 2/74

[52] U.S. Cl. ..... 52/746; 52/98; 52/481

[58] Field of Search ..... 52/99, 98, 100, 173, 52/495, 481, 417, 366, 238, 241, 741, 746, 242, 243, 745

[56] References Cited

U.S. PATENT DOCUMENTS

| | | | |
|---|---|---|---|
| 1,958,871 | 5/1934 | Tucker | 52/167 |
| 2,531,128 | 11/1950 | Hobbs | 52/746 |
| 3,571,999 | 3/1971 | Downing | 24/DIG. 8 |
| 3,956,563 | 5/1976 | Spang | 52/746 |

FOREIGN PATENT DOCUMENTS

| | | | |
|---|---|---|---|
| 1,298,932 | 12/1972 | United Kingdom | 52/481 |

*Primary Examiner*—John E. Murtagh
*Attorney, Agent, or Firm*—Robert F. Hause

[57] ABSTRACT

A wall of gypsum wallboard adhered indirectly to studs, in which the studs have an intermediate material, which has a preplanned degree of weakness, affixed to the stud face, and to which material the wallboard is adhered, to hold it relative to the studs, whereby on removal of the wallboard, the relatively dried bead of adhesive is easily removed from the wallboard back side and/or the stud face, leaving both in condition for reuse with new adhesive, in constructing a new wall.

3 Claims, 2 Drawing Figures

METHOD OF MOUNTING AND DEMOUNTING A WALLBOARD WALL

This invention relates to a novel stud having special material adhered to the face of the stud which is selected to provide a means for removing the dried adhesive readily from the back side of a wallboard and from a stud face when the wallboard and stud are being dismantled, so they can be reused.

There are many systems for affixing wallboard to studs in the construction of partitions. Some systems are designed to permit the disassembly of the wall in a way which permits the reuse of the components in a new wall, and such systems are commonly referred to as demountable partitions. Demountable partitions are normally more costly than the common non-demountable system wherein the wallboard is merely affixed to the studs with an adhesive. A demountable system having all the advantages of the less costly adhesive system would be highly desirable.

It is an object of the present invention to provide a new wallboard demountable partition system.

It is a further object to provide a demountable partition system having the advantages of the normally less costly adhesive system of mounting wallboard.

These and other objects and advantages of the present invention will be more fully apparent when considered in relation to the preferred embodiments thereof as set forth in the specification and as shown in the drawings in which.

Figure 1:
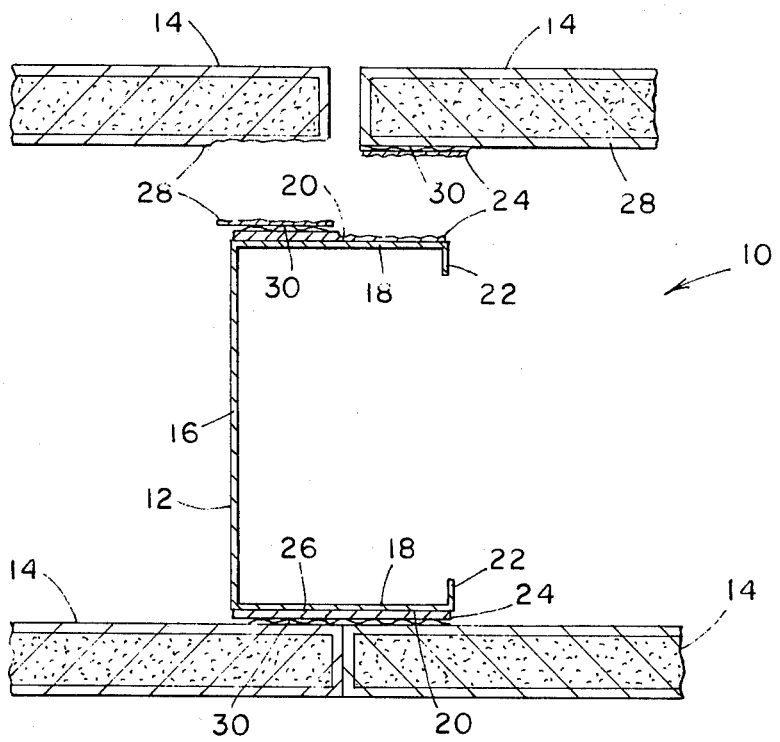
FIG. 1 is a cross-sectional view of a wall embodying the present invention, showing a stud having a weak material bonded to the stud faces, with the wallboards being removed from one stud face.

Referring to FIG. 1, there is shown a section of a wall 10 consisting of a vertical stud 12 and paper-covered gypsum wallboard 14. The stud 12 is a C-shaped sheet metal stud having a central web 16 and a pair of parallel flanges 18, 18 which are perpendicular to web 16 and provide the two opposed parallel stud faces 20, 20 on the outer side of the two flanges 18, 18. Each flange 18 has a short stiffening rib 22 along the edge remote from web 16.

Adhered to each face 20 is a narrow strip of multi-ply paper 24, covering the entire width and length of each face 20, and bonded with a strong adhesive 26 throughout the entire area of the paper 24. Multi-ply paper 24 is preferably of the same formation and stucture as the liner paper 28 which forms the exterior of the paper-covered gypsum wallboard 14. This multi-ply paper 24 is manufactured by a cylinder process. A plurality of thin individual plies are individually formed on separate cylinder screens and are then plied up to form the desired thickness of paper.

This multi-ply paper 24 forms into a unitary strong sheet of paper, which has, however, a slight weakness in the bond of plies to one another. This weakness of the ply bond is of particular advantage in the present invention, as will be further explained hereinbelow.

The wallboard 14 is adhered to the multi-ply paper 24 on the studs 12 by adhesive beads 30. The beads 30 of adhesive are formed along the paper 24 in a manner commonly employed in adhering wallboard directly to metal studs, with the exception of the presence of the multi-ply paper 24. After the adhesive beads 30 are formed in place, the wallboards 14 are placed against the adhesive beads 30 in the manner known in the art. The wallboard is temporarily braced to hold it firmly against the adhesive bead, while the adhesive develops a strong bond, all in accordance with methods known in the art. After the adhesive has set, any temporary bracing is removed, and the wallboard 14 remains adhered to the stud 12 until it is desired to disassemble the wall 10.

In accordance with the invention, when it becomes desirable to disassemble the wall 10, the wallboard 14 is forceably pried off the stud 12 in a way which will cause the multi-ply paper 24 to delaminate, or alternatively in a way which will cause the wallboard liner paper 28 to delaminate.

In FIG. 1, wallboard 14 is shown adhered, in the lower half of the drawing. In the upper half of the drawing, a wallboard 14 is shown on the left, with wallboard liner paper 28 delaminated from being removed from the stud 12, and a second wallboard 14 is shown on the right, with multi-ply paper 24 delaminated from being removed from the stud 12.

To prepare the removed wallboards 14 and the stud 12 for use again, the set adhesive bead 30 is removed from whichever of the wallboard 14 or stud 12 to which it is still adhered. In the example shown in FIG. 1, it will be necessary, in this preferred form of the invention, to remove the upper left adhesive bead 30 from the stud 12, by delaminating the multi-ply paper 24 therebetween, and to remove the upper right adhesive bead 30 from the wallboard 14, by delaminating the wallboard liner paper 28 thereunder.

The wallboard liner paper 28 and the strip of multi-ply paper 24 on the stud 12, before delaminating, are both of a thickness of about 0.020 inch (0.050 cm). In the delaminating process, the paper may delaminate at any plane between about 10% and 90% of the distance in from either surface, and will most often delaminate within the center half of the total paper thickness.

Thus with the delamination occurring in planes that can vary 80% of the paper thickness, it is possible to have variations in the surfaces of the delaminated wallboards and studs which create high or low areas of a degree of about 80% of the paper thickness, or about 0.016 inch (0.040 cm). This amount of unevenness will be readily understood to be of no problem in remounting the wallboards with a new bead 30 of adhesive, since the adhesive thickness can vary when squeezed between the wallboard and stud, to overcome any possible unevenness problem.

After remounting with new adhesive beads 30, the wallboard will normally need to be temporarily braced, to hold it firmly against the adhesive bead while the adhesive develops a strong bond. After the adhesive has set, the temporary bracing is removed, and the remounted wallboard remains adhered to the stud, until it is desired to disassemble the wall again.

In second and subsequent demountings of wallboard from studs, the delamination of the remaining wallboard paper liner and the remaining multi-ply paper strip will obviously result in less and less paper remaining on the stud and wallboard, to an extent that the invention contemplates no more than about three or four demountings and remountings. This, however, is considered completely adequate since builders would not be inclined to involve an adhesive application technique to walls that are likely to need more than about three or four reconstructions in their life.

The advantage of the demountable invention of the present invention lies in the fact that the appearance of a permanent type wall is provided. There are available many methods of wall construction which are suited for many more demounting and remounting cycles than the present invention provides, but such more demountable walls lack the permanent wall appearance of the present invention.

Figure 2:
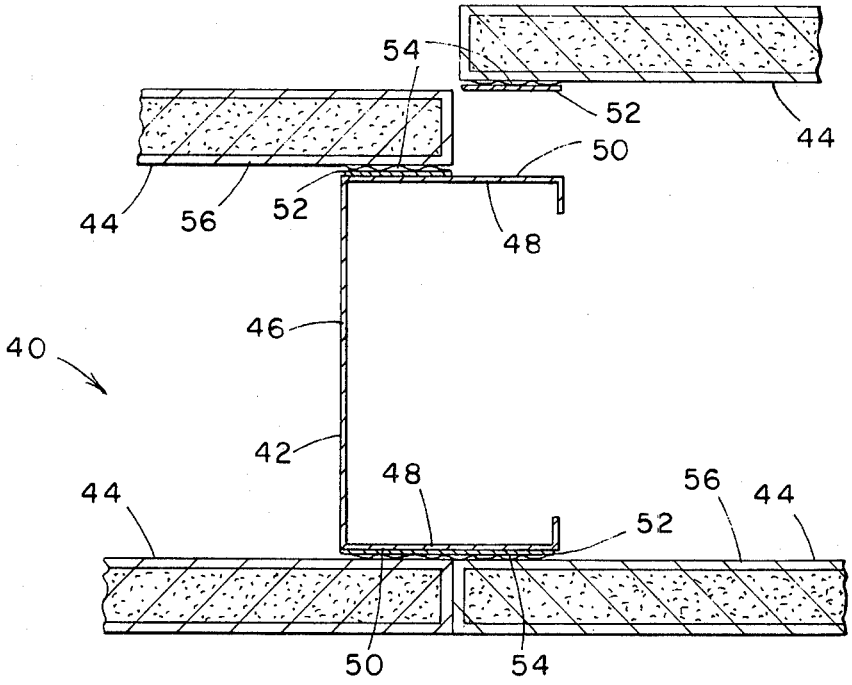
FIG. 2 is a cross-sectional view of a wall embodying the present invention, showing a stud having a weakly bonded material bonded to the stud faces, with one wallboard being removed.

Referring to FIG. 2, a second embodiment of the invention is shown, consisting of a wall 40 having a vertical steel stud 42 and paper-covered gypsum wallboard 44. Stud 42 has a central web 46 and a pair of flanges 48, 48, which provide two opposed parallel stud faces 50, 50.

Adhered to each face 50 is a thin, strippable paint coat 52, having a cohesiveness substantially greater than the adhesiveness to the metal of face 50. As an example, paint coat 52 can be a synthetic rubber applied in a solution form, such as the polyvinyl chloride solution sold under the trademark "Liquid Envelope" by the Jamestown Finisher Division of the Essex Chemical Corporation, which is sold primarily for use on paint spray booths. The strippable paints have a good bond until a slight force is applied to strip the coating off, at which time the entire coating can be easily stripped off as a single unit.

Wallboard 44 is adhered to the strippable coat 52 on the studs 42 by adhesive beads 54. The beads 54 are formed along the coat 52 in a manner commonly employed in adhering wallboard directly to metal studs, with the exception of the presence of the strippable coat 52. After the adhesive beads 54 are formed in place, the wallboards 44 are placed against the adhesive beads 54 in the manner known in the art. The wallboard is temporarily braced until the adhesive of beads 54 becomes firm, and the wallboard remains assembled until it is desirable to disassemble the wall 40.

In accordance with the invention, when it becomes desirable to disassemble the wall 40, the wallboard is forceably pried off the stud 42, in a way which will cause the wallboard liner paper 56 to delaminate, or alternatively in a way which will cause the strippable coat 52 to peel completely off the stud 42.

To prepare the removed wallboard 44 and the stud 42 for use again, the set adhesive bead 54 is removed from whichever of the wallboard 44 or stud 42 to which it is still adhered.

Prior to reusing the stud 42, a new strippable coat 52 may be applied to the faces 50, 50.

Thus in both of the preferred embodiments, the multiply paper and the strippable coating, it will be seen that a certain critical relationship of the tensile strengths in the three respective perpendicular directions is essential to the invention. The tensile strength of both the multiply paper and of the strippable coating on the stud, in the two perpendicular directions which are parallel to the stud face, which may be referred to as $x$ and $y$ directions, is substantially greater than the tensile strength in a $z$ direction, which is perpendicular to the plane of the stud face. In the case of the multi-ply paper, the weakness in the $z$ direction is internal, ply to ply whereas in the case of the strippable coating embodiment, the weakness in the $z$ direction is at the interface of the stud and the strippable coating. Thus a weak plane is formed, within a space of from the stud face to within the thin material adhered to the stud face, which provides a $z$ tensile substantially less than the $x$ and $y$ tensiles of the thin material.

Having completed a detailed disclosure of the preferred embodiments of my invention, so that others may practice the same, we contemplate that variations may be made without departing from the essence of the invention or the scope of the appended claims.

I claim:

1. The method of mounting and demounting a paper-covered gypsum wallboard wall comprising the steps of applying a thin material to the face of a wall stud receptive to adhesion thereto of a bead of wallboard adhesive and having a weak plane parallel to said stud face within a space of from said face to within said material, applying a bead of wallboard adhesive to said material, applying said wallboard to said bead of adhesive, permitting a bond to develop of said material to said bead of adhesive and said bead of adhesive to said wallboard, and subsequently dismounting said wall by removing said wallboard from said stud and removing said bead of wallboard adhesive from both said stud and said wallboard, said removal of said adhesive bead from said stud being by separating at least a part of said material from said stud at said weak plane.

2. The method of claim 1 wherein said bead of adhesive is removed from said wallboard by removing a part of the thickness of the wallboard paper to which said adhesive bead is adhered.

3. The method of claim 1 wherein said material is multi-ply paper, and said removal of adhesive bead from said stud is by removing a portion of the thickness of said multi-ply paper from said stud.

* * * * *